United States Patent [19]

Michlin

[11] Patent Number: 4,473,282

[45] **Date of Patent: * Sep. 25, 1984**

[54] DIAZO COPY MACHINE WITH AMMONIA VAPOR ABSORBER

[76] Inventor: Norman Michlin, 28200 Bell Rd., Southfield, Mich. 48034

[ * ] Notice: The portion of the term of this patent subsequent to Dec. 1, 1998 has been disclaimed.

[21] Appl. No.: 278,947

[22] Filed: Jun. 30, 1981

[51] Int. Cl.[3] ..... G03D 7/00

[52] U.S. Cl. ..... 354/300; 55/70; 55/387; 422/168; 423/237

[58] Field of Search ..... 354/297, 300; 55/70, 55/74, 387; 422/168; 34/36, 140, 150; 423/237; 355/27, 100

[56] References Cited

U.S. PATENT DOCUMENTS

| | | | |
|---|---|---|---|
| 2,696,771 | 12/1954 | Frantz | 354/300 |
| 3,679,369 | 7/1972 | Hashimoto et al. | 55/70 |
| 3,720,150 | 3/1973 | Hurtig et al. | 55/70 |
| 3,900,862 | 8/1975 | Bennett et al. | 354/300 |
| 4,059,409 | 11/1977 | Barto et al. | 55/387 |
| 4,092,658 | 5/1978 | Schroter | 354/300 |
| 4,166,728 | 9/1979 | Degenhardt et al. | 354/300 |
| 4,167,319 | 9/1979 | Feitzinger et al. | 354/300 |
| 4,286,859 | 9/1981 | Kurek | 355/27 |
| 4,303,329 | 12/1981 | Michlin | 354/300 |

*Primary Examiner*—A. A. Mathews

*Attorney, Agent, or Firm*—Krass & Young

[57] ABSTRACT

A diazo copy machine of the type utilizing ammonia vapors to develop exposed copy material and which utilizes a suction chamber for collecting and drawing off the ammonia vapors escaping from the development chamber and given off by developed copy material. The disclosed machine features an integrated ammonia vapor absorber canister which is mounted within the copier housing or secured by means of brackets to the rear of the machine housing and through which is directed the collected ammonia vapors by means of a plugin tube insertable in one end of the canister. This directs the ammonia vapor containing discharge from the suction chamber through the canister. In one version, the canister contains a composite of granular and fibrous absorbent materials to insure complete absorption of the ammonia vapors and to avoid channelization of the materials. In this latter version, the canister is inclined upwardly from the point whereat the ammonia vapor containing exhaust is directed into the canister to provide further protection against channelizing of the absorbent material within the canister.

1 Claim, 2 Drawing Figures

DIAZO COPY MACHINE WITH AMMONIA VAPOR ABSORBER

BACKGROUND DISCUSSION

Diazo copy machines utilize ammonia vapor which is brought into contact with diazo dye-coated copy material which has previously been exposed with respect to an original overlaying the same. The ammonia reacts with the diazo dyes to produce a developed print. The process is very useful and is in extremely widespread use, but does have the disadvantage of incidental generation of ammonia odor associated with the operation of the machine and with developed prints.

In an effort to eliminate such odors, machines have heretofore been provided with suction chambers which collect and supply a vacuum to a region adjacent the development chamber and serves to tend to collect the ammonia vapors escaping from the development chamber, as well as given off by the developed copy material. The ammonia vapor containing exhaust from the suction chamber cannot be directly exhausted to the room air, but rather is either exhausted to the outside of the building, or is caused to rise through an ammonia absorbing canister prior to exhaust into the room.

In this latter arrangement, a length of flexible hose or tube is extended from the machine in a position with its outlet beneath the bottom opening formed in the canister. The exhaust thus flows through the absorption canister prior to being returned into the room air.

This arrangement has the disadvantage of necessitating a separate assembly from the machine which must be set up at the installation of the machine and requires additional space for the operation of the machine as well as adding to the cost of set up. In addition, the exhaust from the suction chamber is sometimes merely allowed to be blown generally toward the canister such that some escape of the suction chamber exhaust is possible so that ammonia vapors evacuated from the machine may escape into the surrounding room air.

A problem involved in the use of granular material absorbers in gas purification applications is that of channelization.

Since such canisters sometimes use granular material such as activated carbon granules, channelization will sometimes occur if a horizontal installation were attempted. Such channelization is the formation of low resistance flow paths through the granular material due to crusting of the granular material and the tendency of the flow to occur primarily through these low resistance flow paths.

Such flow of course reduces the operating effectiveness of the unit in removing ammonia vapors due to the resultant reduced, effective quantity of absorbent material available, leading to premature exhaustion of the canister.

Accordingly, it is an object of the present invention to provide a diazo copy machine with an integrated ammonia absorber canister which forms a part of the machine, which can be installed at the assembly of the machine such that the machine requires less floor space and the setting up of the machine for operation if simplified.

It is a further object of the present invention to provide such ammonia absorbing canister installation in which the exhaust from a suction chamber is directed into the absorber canister in such a manner as to preclude the bypassing of any of the suction chamber flow into the room air, while allowing ready assembly of the exhaust tube and canister.

It is still another object of the present invention to provide such an absorber canister including absorbent material with a reduced tendency for the occurrence of channelization.

SUMMARY OF THE INVENTION

These and other objects of the present invention, which will become apparent upon a reading of the following specification and claims, are achieved by a diazo copy machine in which the absorber canister is installed either in an inside compartment contained within the copy machine itself which extends in a generally horizontal direction, or on bracketry secured to the copy machine housing extending across the back thereof.

The exhaust from the suction chamber is directed through a tube which is plugged into the inlet side of the absorber canister such as to direct the entire exhaust flow from the suction chamber through the absorber canister.

The absorber canister material includes a composite mixture of granular and fibrous materials including activated charcoal and treated vermiculite, and phosphoric acid treated excelsior.

The resultant mixture exhibits a greatly reduced tendency to channelization, and absorbs more effectively over a range of operating conditions.

The installation of the canisters is preferably in an inclined-from-the-horizontal position to counteract the tendency for channelization to occur due to the resettling effect due to the inclination of the filter from the horizontal.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the apended claims.

Figure 1:
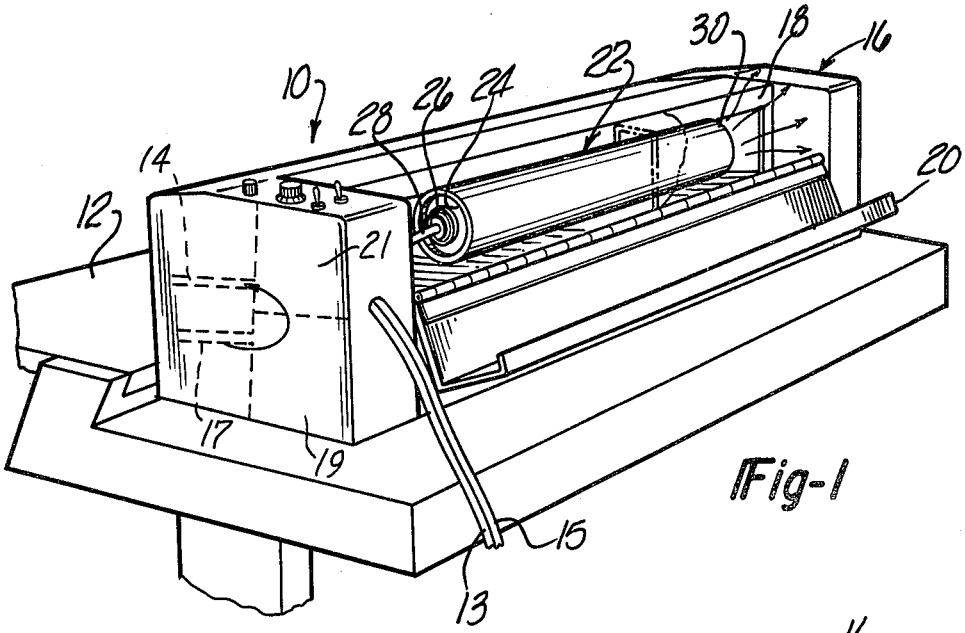
FIG. 1 is a perspective view of a diazo copy machine employed in the integrated absorber canister according to the present invention shown in a housing channel section open to reveal the absorber canister installation within the copy machine housing.

Referring to the drawings and particularly to FIG. 1, the present invention finds particular utility with a conventional diazo copy machine 10 operating under well known principles. Briefly, the diazo copy material and the original are positioned on a front table 12 and then fed through an exposure station (not shown) in the machine where a fluorescent tube is caused to expose the original image onto the copying material. Both the original and the copy pass out of the machine and the copy material is reinserted into slot 17 for developing the image. The diazo copy material is driven through a developing chamber 19 where the exposed copy material is treated with ammonia vapors to develop the image. The developed copy material passes through a vacuum chamber 21 and out of machine 10 via upper slot 14. The vacuum chamber 21 deserves to draw off the ammonia vapors escaping from the developing chamber 19 and given off by the developed material. Various constructions of the particular elements making up machine 10 are well known to persons skilled in the art and thus have not been shown in great detail in the drawings.

According to the concept of the present invention, the housing 16 is provided with a longitudinal compartment 18 to the rear of the machine, in the version depicted in FIG. 1, which is adapted to be enclosed by a hinged rear cover 20. Within the longitudinal compartments 18 is disposed an absorber canister 22 which is relatively elongated and mounted to extend in a generally horizontal direction disposed within the longitudinal compartment 18.

The absorber canister 22 receives at the end 24 a plug-in fitting 26 which is secured to the end of the evacuation tube 28 into which the ammonia exhaust form vacuum chamber 23 is pumped under pressure. The vapors are thus introduced into the plug-in fitting 26 causing all of the ammonia vapor containing exhaust to pass down the length of the ammonia vapor absorber canister 22 and thence exit at the opposite end 30 as depicted in FIG. 1.

The ammonia vapor return and supply lines 13 and 15 are in communication with conventional ammonia vapor supply or preferably of the type disclosed in U.S. Pat. No. 3,915,708, which describes an ammonia-water solution containing carbon dioxide which reduces the degree of ammmonia vapor escape, as described in detailed in that patent.

The canister 22 preferably contains a composite mixture of granular and fibrous absorbing materials to reduce the tendency to channelize, and each of such materials has a somewhat different absorbent characteristic such that a more complete absorbing of the ammonia fumes under various operating conditions can be insured. This mixture includes more or less equal parts of activated charcoal granules, vermiculite granules treated with phosphoric acid, and also a fibrous absorbent excelsior also treated with phosphoric acid.

This mixture of fibrous and granular absorbents produces a composite absorbent material having the favorable attributes of each. The presence of the excelsior tends to prevent crusting and channelization, which in the presence of the granular charcoal and vermiculite increases the density of the composite by being packed into the spaces between the granules and results in a broad spectrum absorbent characteristic.

All of these substances effectively absorb ammonia such that the exhaust from the canister 22 will be substantially free of ammonia vapors.

Thus, upon closing of the hinged rear cover 20, the machine provides a very compact structure, with the canister 22 added by the manufacturer of the machine, while still enabling easy maintenance access for replacement of the canister 22.

Figure 2:
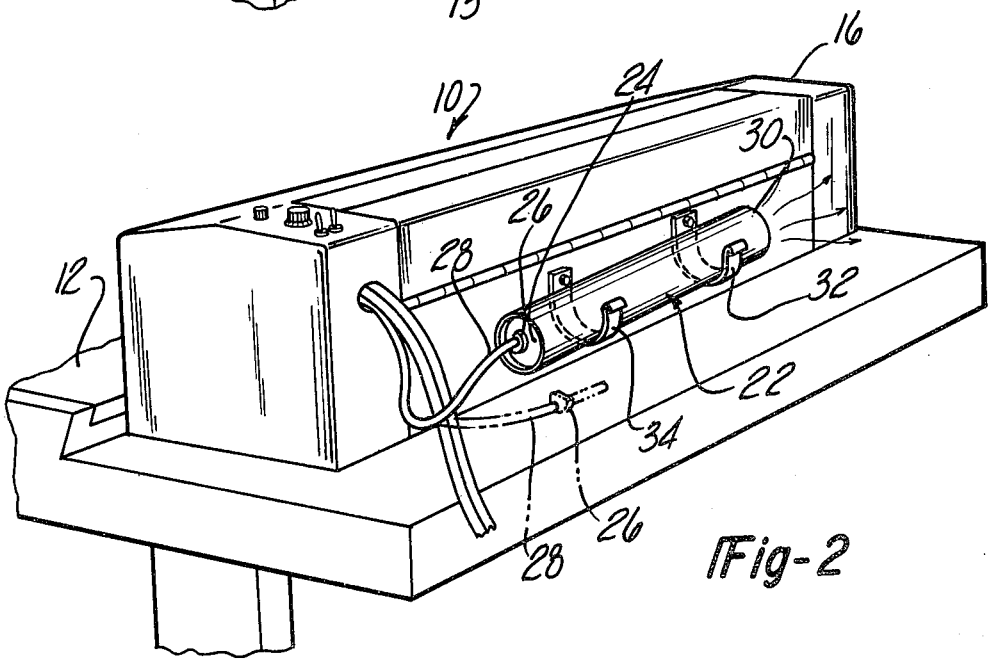
FIG. 2 depicts a rear view of a diazo copy machine showing an alternate variation in which the absorber cartridge is mounted via brackets affixed to the rear of the machine in a slightly inclined position, depicting in phantom the suction chamber tube and plug fitting prior to installation of the absorber canister.

The plug-in fitting 26, shown in FIG. 2, is simply friction fit within an opening contained in end 24 of the canister 22 to thus provide ready removal thereof. The inclined horizontal disposition of the canister 22 provides much more compact storage thereof than the separately disposed vertical canister utilized in past designs.

The use of plug-in fitting 26 and the evacuation tube 28 insures that the ammonia vapor containing exhaust from the vacuum chamber 21 is completely passed through the canister 22.

The various details of the diazo copy machine 10, including the details of the developer chamber, the vacuum chamber, the light exposure tubes, etc., are not here described inasmuch as these details are well known to those skilled in the art and are not necessary for an understanding of the present invention.

FIG. 2 depicts a similar diazo copy machine in which the canister is mounted exteriorly of the housing 16 positioned alongside the rear of the machine by means of a pair of brackets 32 and 34 affixed to the machine housing 16 and which serve to position and retain the canister 22 as a part of the machine assembly.

As shown in that FIGURE, the canister 22 is caused by the positioning of the brackets 32 and 34 to be inclined from the horizontal such that the lower end is the end whereat the evacuation tube 28 and the plug-in fitting 26 enter into the end 24 of the canister 22 with the opposite end 30 where the purified air exits the canister. This slight vertical disposition of the canister 22 will also tend to prevent the occurrence of channelization when granular materials such as activated charcoal granules and vermiculite are employed as the absorber material within the canister 22, since the resettling effect of gravity will tend to offset any tendency to channelize while preserving the generally horizontal disposition of the canister which enables it to be mounted directly to the machine housing 16 itself.

Accordingly, it can be appreciated that the objects of the present invention have been achieved by this configuration since the canister 32 is now integrated with the diazo copy machine 10, while enabling ready access thereto and convenience for changeover of absorber canisters.

Thus, the unit is compact compared relative to the prior art separate installation of the canister 22. In addition, the use of the plug-in fitting 26 rather than a simple blow-through arrangement, as per the prior art practice, insures that all of the ammonia absorber containing exhaust from the vacuum chamber 21 is caused to pass through the canister 22. The inclination of the preferred embodiment of FIG. 2 tends to preclude the occurrence of channelization due to the resettling effect of gravity on the granular absorbent material, as does the fibrous-granular characteristic of the absorbent material.

I claim:

1. In a diazo copy machine of the type including a developing chamber in which a sheet of diazo copy material is exposed to ammonia vapor and then passed through a vacuum chamber to which suction is applied to cause ammonia vapors contained therein to flow through an evacuation tube, with said sheet then passing out of said machine, said sheet moving through the machine with a motion transverse to the length of the machine, the improvements comprising:

an elongated canister containing a mixture of substantially solid absorbing particles supported on said diazo copy machine with its elongate axis extending substantially along the length of the machine, and means for connecting said evacuation tube to said canister to insure that substantially all of the vapor evacuated from said vacuum chamber passes through said canister, said canister being supported on the machine so that its elongate axis is inclined slightly from the horizontal and wherein said evacuation tube enters said ammonia absorbing canister at a point on the lower end of said ammonia absorbing canister, the canister containing a composite mixture of granular-fibrous absorbent materials, said granular material including activated charcoal granules and vermiculite granules treated with phosphoric acid and said fibrous absorbant material including phosphoric acid treated excelsior.

* * * * *